US011167969B2

(12) United States Patent
Boylu et al.

(10) Patent No.: US 11,167,969 B2
(45) Date of Patent: Nov. 9, 2021

(54) FULL FREE TRIPLEX FORKLIFT MAST WITH MAXIMIZED OPERATOR VIEW

(71) Applicants: Tuna Boylu, Izmir (TR); Erkan Boylu, Izmir (TR)

(72) Inventors: Tuna Boylu, Izmir (TR); Erkan Boylu, Izmir (TR)

( * ) Notice: Subject to any disclaimer, the term of this patent is extended or adjusted under 35 U.S.C. 154(b) by 0 days.

(21) Appl. No.: 16/634,265

(22) PCT Filed: Jul. 25, 2017

(86) PCT No.: PCT/TR2017/050336

§ 371 (c)(1),
(2) Date: Jan. 27, 2020

(87) PCT Pub. No.: WO2019/022681

PCT Pub. Date: Jan. 31, 2019

(65) Prior Publication Data

US 2021/0087034 A1 Mar. 25, 2021

(51) Int. Cl.
*B66F 9/08* (2006.01)
*B66F 9/20* (2006.01)

(52) U.S. Cl.
CPC ..... *B66F 9/08* (2013.01); *B66F 9/205* (2013.01)

(58) Field of Classification Search
CPC ..... B66F 9/08; B66F 9/205
See application file for complete search history.

(56) References Cited

U.S. PATENT DOCUMENTS

| | | | |
|---|---|---|---|
| 4,635,757 A | 1/1987 | Yamagishi et al. | |
| 4,949,816 A | 8/1990 | Brown et al. | |
| 5,000,293 A | 3/1991 | Brown et al. | |
| 6,193,015 B1 | 2/2001 | Kato et al. | |
| 6,505,710 B1 | 1/2003 | Kato | |
| 7,096,999 B2 | 8/2006 | Lewis et al. | |
| 7,398,859 B2 * | 7/2008 | Lewis | B66F 9/08 187/226 |

FOREIGN PATENT DOCUMENTS

| | | |
|---|---|---|
| EP | 2295366 A1 | 3/2011 |
| GB | 803066 A | 10/1958 |
| JP | S5476072 U | 5/1979 |

OTHER PUBLICATIONS

International Search Report for corresponding PCT/TR2017/050336.
Written Opinion of the ISA for corresponding PCT/TR2017/050336.

* cited by examiner

*Primary Examiner* — Minh Truong

(74) *Attorney, Agent, or Firm* — Egbert, McDaniel & Swartz, PLLC

(57) ABSTRACT

Disclosed is a full free-lift triplex forklift mast assembly with increased operator forward view, including an outer mast, a middle mast, an inner mast and a carriage. The carriage includes a pair of lift cylinders, located rearwardly of the outer mast and mounted on top of lower cross-tie, which upon commands from the operator extend or retract, thus move the middle mast accordingly in vertical direction without the lift cylinders obstructing the space between the inner mast profiles. Mechanisms are also provided such that the inner mast, the carriage and free-lift chain pulleys can be moved in a vertical direction while providing maximized forward visibility through the mast assembly.

5 Claims, 12 Drawing Sheets

FULL FREE TRIPLEX FORKLIFT MAST WITH MAXIMIZED OPERATOR VIEW

TECHNICAL FIELD

This invention relates to a triple stage mast assembly for forklift trucks, which are in widespread use for hoisting and moving materials in factories and warehouses.

The invention is about reorganizing the lifting mechanism and other mast elements, which interfere with the vision of the operator, thus maximizing the operator's field of view when looking forward through the mast.

BACKGROUND OF THE RELATED ART

A forklift is an industrial truck to lift and move heavy loads. The mast assembly attached to the front end of the forklift is the mechanism, which lifts and lowers the load in vertical axis. A triplex mast is a triple stage telescopic lifting mechanism, which lifts the load up to approximately three times as high as the closed height of the mast. A forklift mast with "full free-lift" feature enables a forklift to lift and move loads in places with limited height such as inside a container. "Full free-lift", allows a forklift to lift the load to a certain height, without any of the mast units rising above the closed height of the mast. This is necessary since extension of the mast in places with limited height, makes it impossible to work and load the goods on top of each other. This is why "full free lift" masts are exclusively preferred.

The most persistent problem encountered in full free lift triplex forklifts is the placement of lifting units such as hydraulic cylinder(s), chain(s) and hydraulic hose(s) in the middle of the inner mast. Such positioning restricts the operator's field of view considerably. Impaired operator forward visibility results in increased forklift accidents causing injuries and material losses. It also affects productivity, increasing time spent during material handling tasks. Furthermore because of impaired operator forward visibility, other workers have to help the operator for maneuvering, causing additional workforce and time loss. A typical full free-lift triplex mast having a lift cylinder in the middle is shown in FIG. 8.

Various attempts have been made in the prior art to improve forward visibility through the mast assembly. These include reducing the number of ties between the masts as disclosed in U.S. Pat. No. 4,635,757; locating the free lift hydraulic cylinders in front of the triplex mast assembly as disclosed in U.S. Pat. No. 5,000,293; and positioning the free lift cylinders behind the inner mast by using non-standard mast profiles as disclosed in U.S. Pat. No. 6,505,710. More recent attempts include widening the mast assembly while keeping the free lift cylinder in the middle of the inner mast as disclosed in, EP 2,295,366 and asymmetric positioning of free lift hydraulic cylinders behind the inner mast as disclosed in U.S. Pat. No. 7,096,999.

Some disadvantages of the prior art can be summarized as less stable and less rigid construction in U.S. Pat. No. 4,635,757 caused by removal of ties between the masts; high risks of serious damage and injury in the event of even minor accidents because of locating the lifting mechanism unprotected and close to the load in front of the triplex mast as disclosed in U.S. Pat. No. 5,000,293; relative complexity of construction in U.S. Pat. No. 6,505,710 caused by lifting mechanism positioning and non-standard mast profile usage; not enough improvement of operator's front vision because of keeping the free lift cylinders in the middle of the inner mast as disclosed in EP 2,295,366; and again complex structure with all mast profiles being different as well as not maximized operator front view due to asymmetric location of free lift cylinders as disclosed in U.S. Pat. No. 7,096,999.

For the aforementioned reasons, there remains a need for a relatively simple, rigid and effective full free-lift triplex mast.

PURPOSE OF THE INVENTION

The present invention offers vastly improved forward visibility through the mast while overcoming the disadvantages of prior art by embracing a compact and symmetric design. This is achieved by the utilization of cross sectionally shaped standard profiles for all the masts and substantial reorganization of the lifting mechanism.

The primary purpose of the invention is to construct a full free-lift triplex mast for a forklift with maximized operator view.

Another important purpose of the invention is to provide a compact and symmetric mast assembly, in which overall rigidity is enhanced and overall construction is simplified.

An aspect of the invention provides a full free-lift triplex mast with enhanced lifting protection by placement of all lifting elements behind the masts.

BRIEF DESCRIPTION OF THE DRAWINGS

The invention will be described by referring to the drawings, thus the property of the invention will clearly be understood. However the purpose of this is not to limit the invention by certain configurations. On the contrary, the aim is to cover all the alternatives, which can be described in the attached claims.

The details of the drawings just show the configurations of the invention for better understanding. In these drawings.

Figure 1:
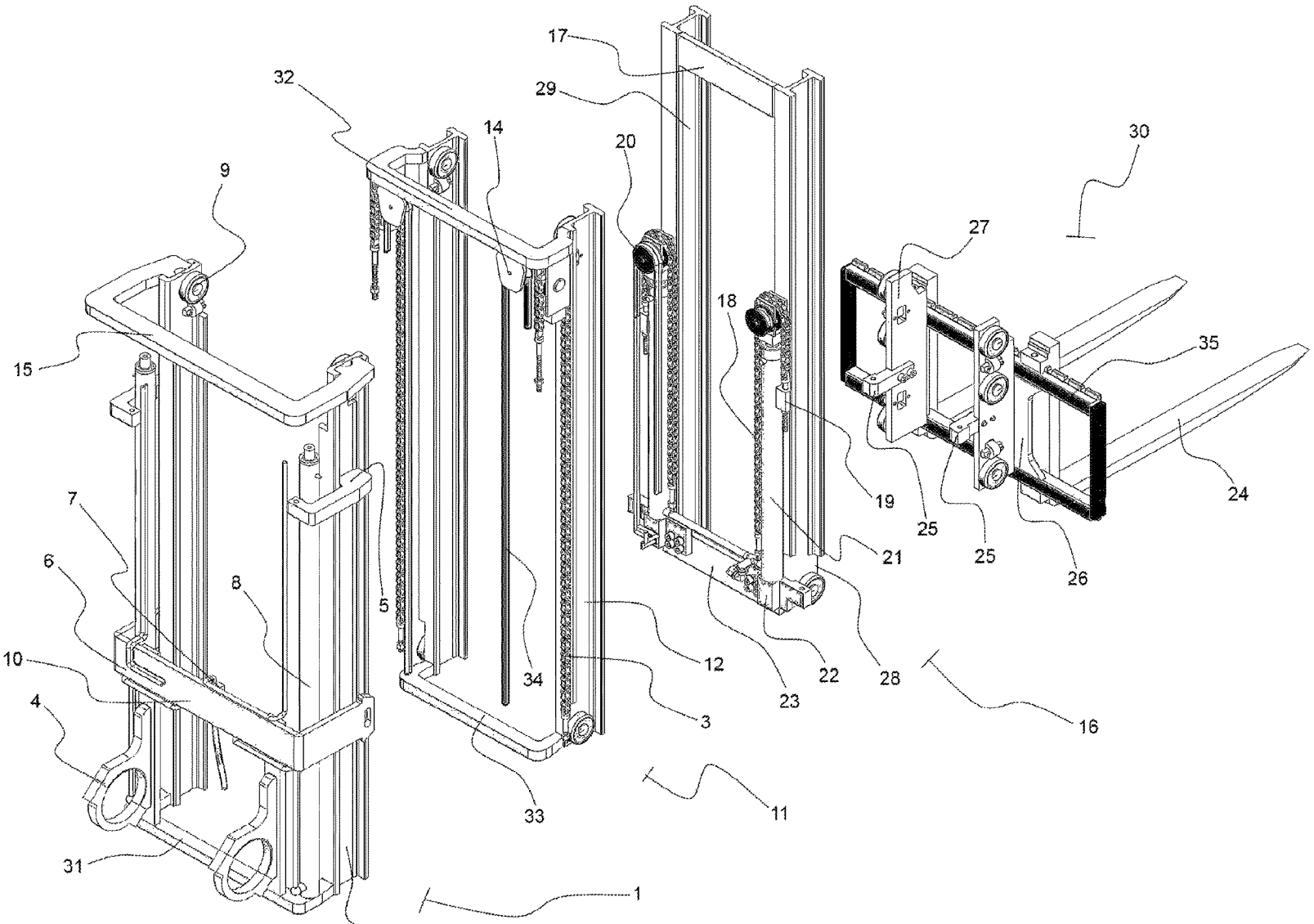
FIG. 1 is an exploded perspective view of the invention

To better understand the invention, attached figures are numbered with their nomenclatures below:

DESCRIPTION OF REFERENCES

1. Outer mast
2. Outer mast profile
3. Lift chain
4. Mounting bracket 5. Outer mast chain anchor
6. Hydraulic pipe
7. Hydraulic distributor
8. Lift cylinder
9. Bearing
10. Support piece
11. Middle mast
12. Middle mast profile
13. Lift chain pulley
14. Hydraulic hose pulley
15. Upper cross-tie
16. Inner mast
17. Inner mast upper cross-tie
18. Free-lift chain
19. Inner mast chain anchor
20. Free-lift chain pulley
21. Free-lift cylinder
22. Multifunctional lift base
23. Inner mast lower cross-tie
24. Fork
25. Carriage anchor
26. Vertical support plate
27. Carriage lift bracket
28. Cut-out
29. Inner mast profile
30. Carriage
31. Lower cross-tie
32. Middle mast upper cross-tie
33. Middle mast lower cross-tie
34. Hydraulic hose
35. Carriage profile

DETAILED DESCRIPTION OF THE INVENTION

The present invention is a triplex forklift mast assembly, having full free-lift ability, with vastly improved operator front view, comprising of a carriage (30), moving vertically within an inner mast (16), which moves vertically within a middle mast (11), which moves vertically within an outer mast (1). (FIG. 1)

Figure 2:
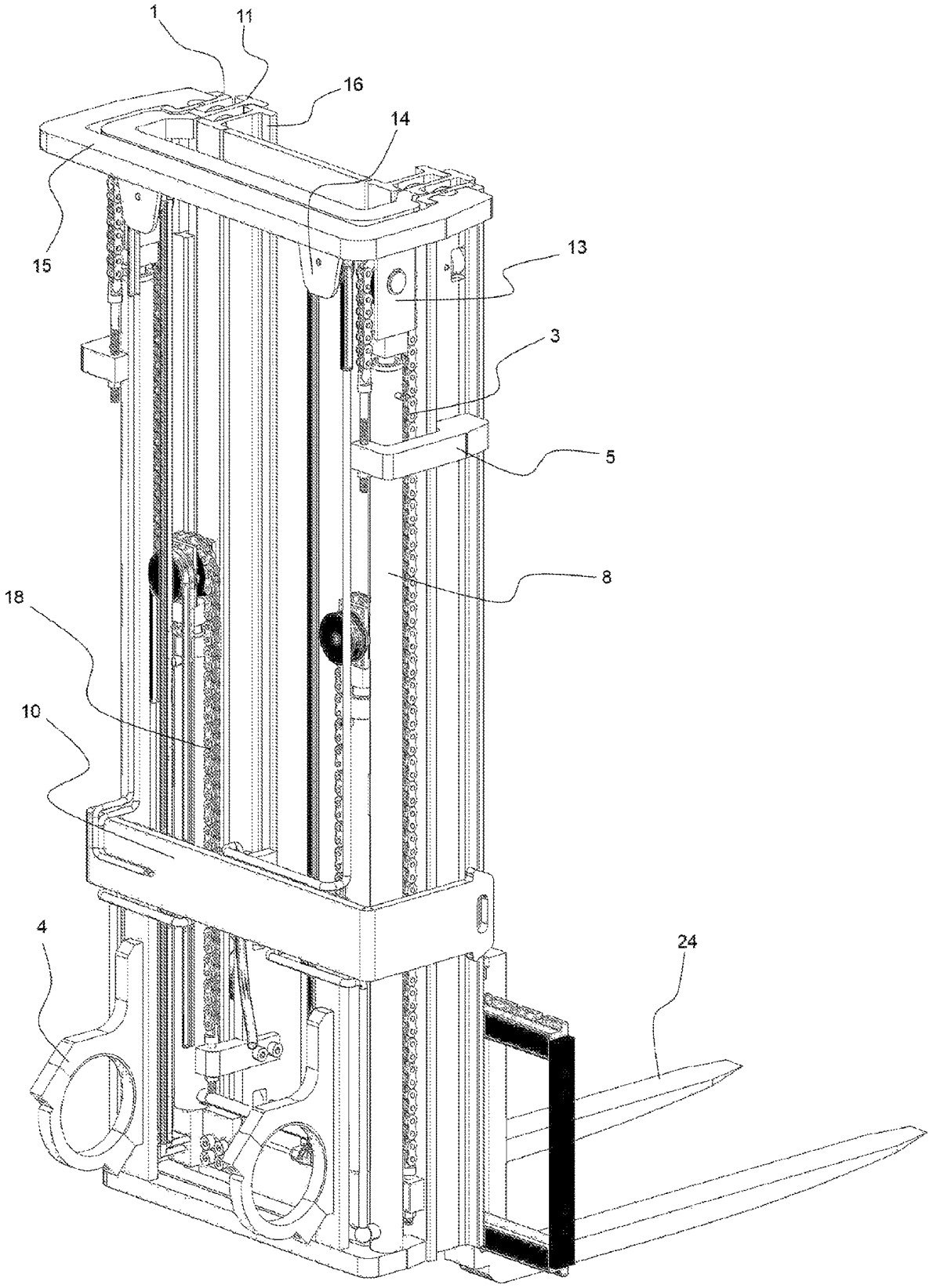
FIG. 2 is a perspective view of the mast assembly embodying the principles of the present invention
Figure 8:
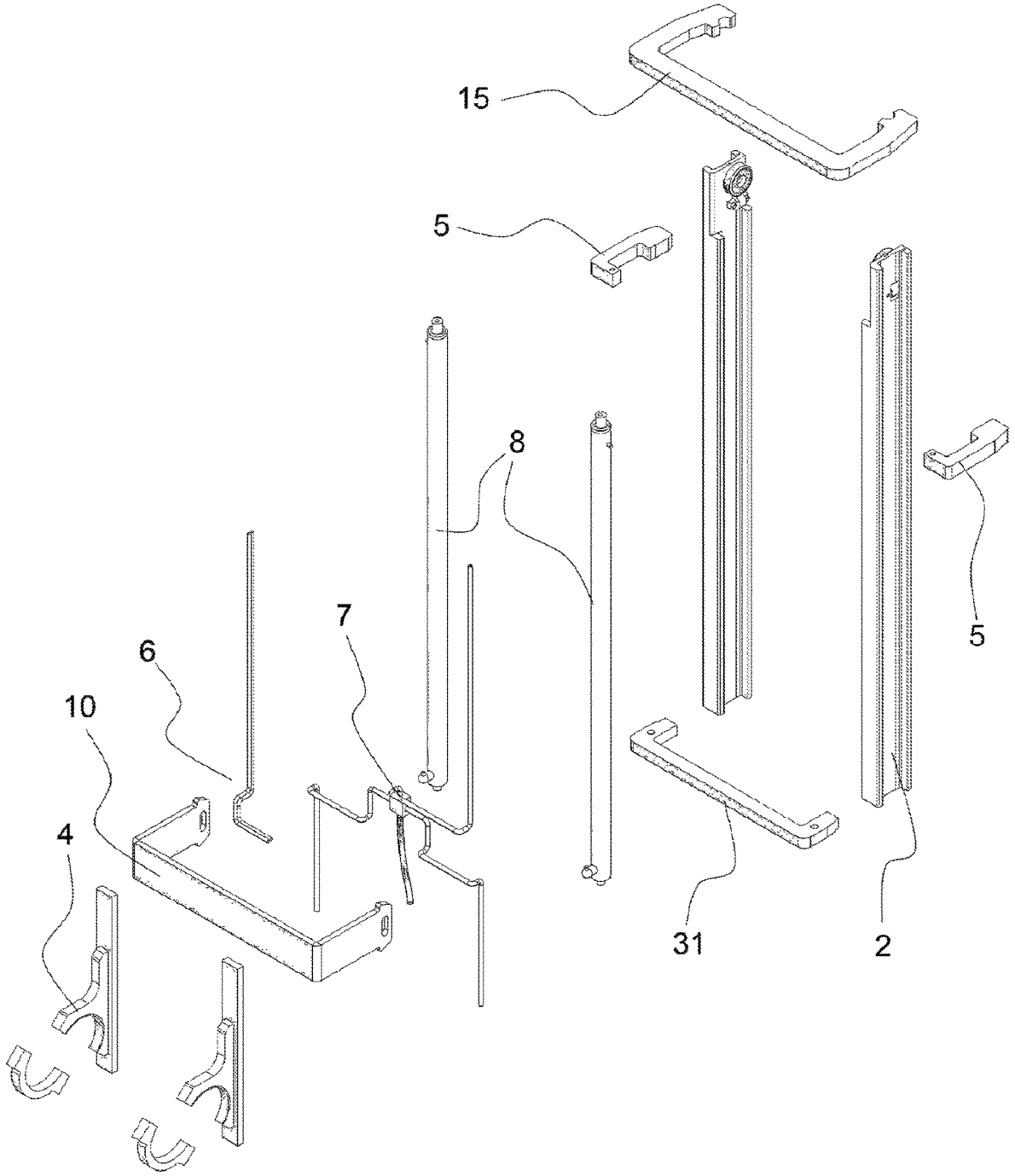
FIG. 8 is an exploded perspective view of outer mast

The outer mast (1) in the invention comprises of two cross sectionally I-shaped outer mast profiles (2) fixed together with a lower cross-tie (31) at their bottom ends, a support piece (10) in the middle and an upper cross-tie (15) at their upper ends. A pair of mounting brackets (4), rigidly connected between the lower cross-tie (31) and support piece (10), attach the mast assembly to the forklift. Bearings (9) facing middle mast profiles (12) are rotatably mounted to the surface of outer mast profiles (2) at the top, which enable the middle mast (11) to move within the outer mast (1). A pair of lift cylinders (8) are mounted on the lower cross-tie (31), with their rods arranged to extend and retract with the middle mast (11). The lift cylinders (8) are positioned behind the outer mast profiles (2) without obstructing the space between the inner mast profiles (29). Rods of the lift cylinders (8) and a lift chain pulley (13), placed on the rear side of the mast assembly, are fixed to the middle mast (11) via the middle mast upper cross-tie (32). (FIG. 1). A pair of lift chains (3), with one end anchored to the multifunctional lift base (22) and other end attached to the outer mast chain anchor (5), extend over the lift chain pulleys (13) and raise and lower the inner mast. Thus movement of the middle mast (11) and the inner mast (16) is realized in vertical direction with the extension of lift cylinder (8) rods. A hydraulic distributor (7) attached to the support piece (10), is hydraulically connected to the lower part of the lift cylinders (8) via a combination of hydraulic pipes (6) and hoses. (FIGS. 1, 2, 8)

Figure 9:
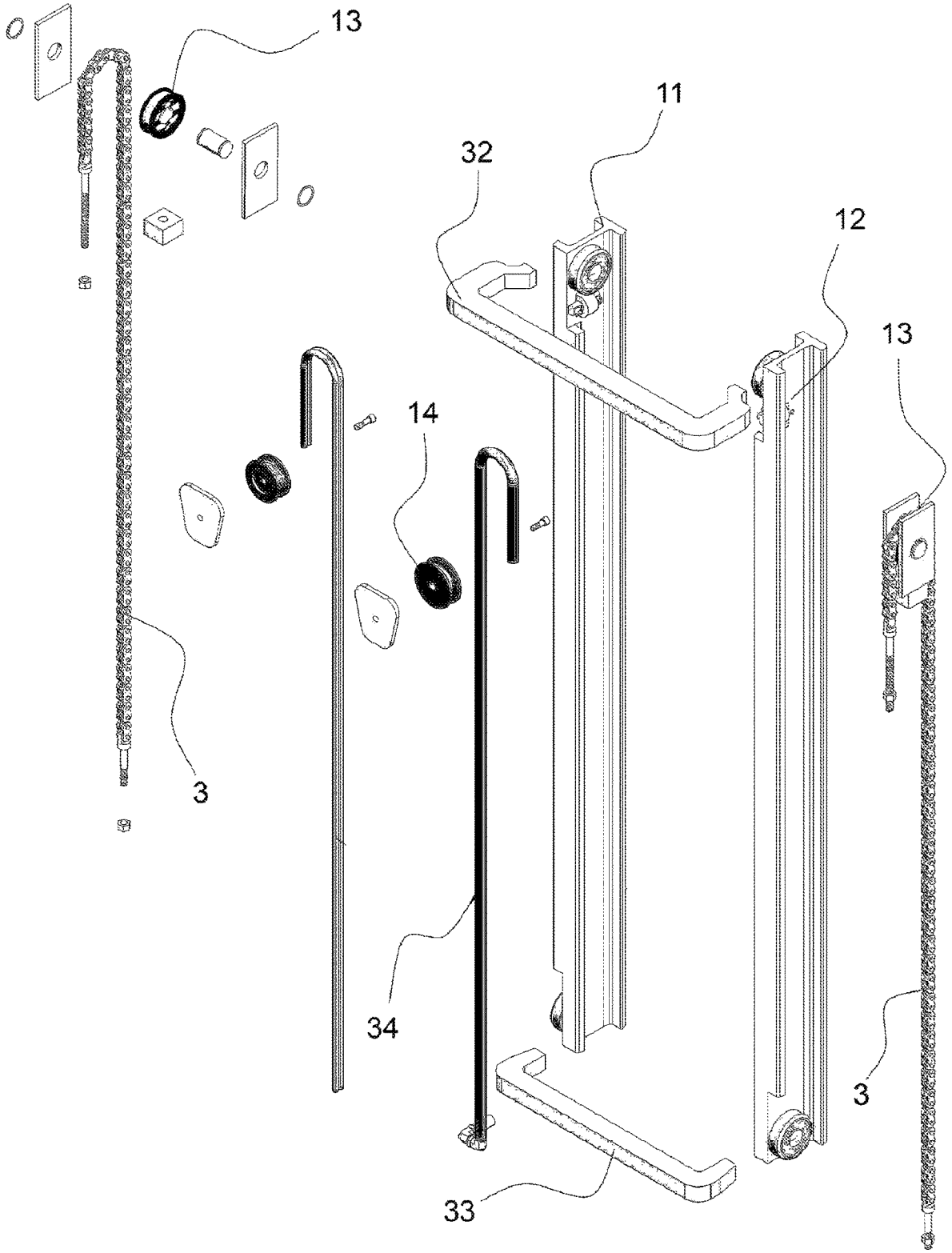
FIG. 9 is an exploded perspective view of middle mast

The middle mast, in the invention (11) is formed by a pair of horizontally spaced middle mast profiles (12) rigidly connected with a middle mast lower cross-tie (33) between their bottom ends and a middle mast upper cross-tie (32) between their top ends. A pair of lift chain pulleys (13) are mounted to the middle mast upper cross-tie (32) rearwardly of the middle mast (11), for lift chains (3) to be applied thereover. The vertical movement of the inner mast (16) within the middle mast (11) and the middle mast (11) within the outer mast (1) are guided by bearings (9) which are rotatably mounted to the upper inner and lower outer ends of the middle mast profiles (12), respectively. (FIGS. 1, 2, 9)

Figure 10:
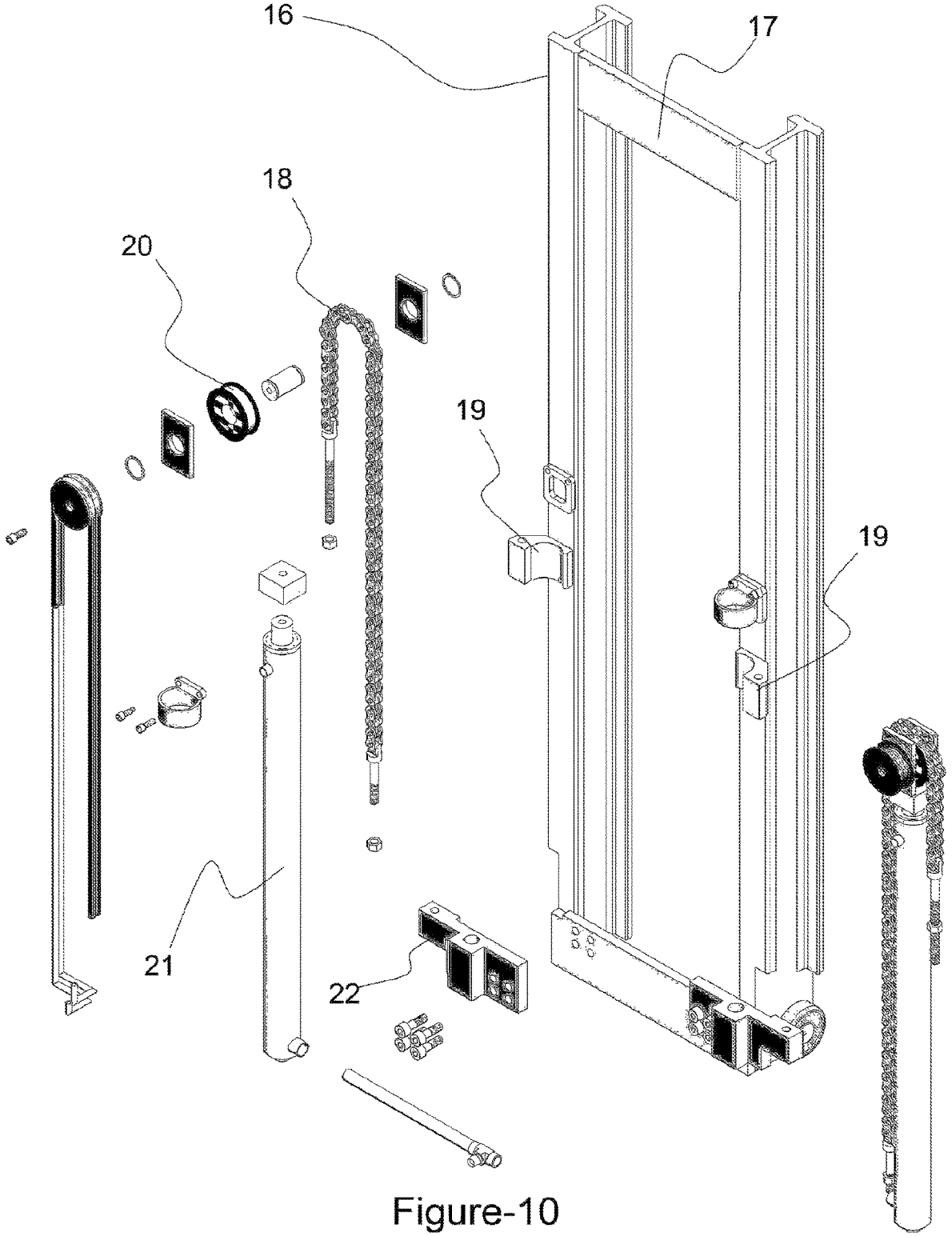
FIG. 10 is an exploded perspective view of inner mast
Figure 11:
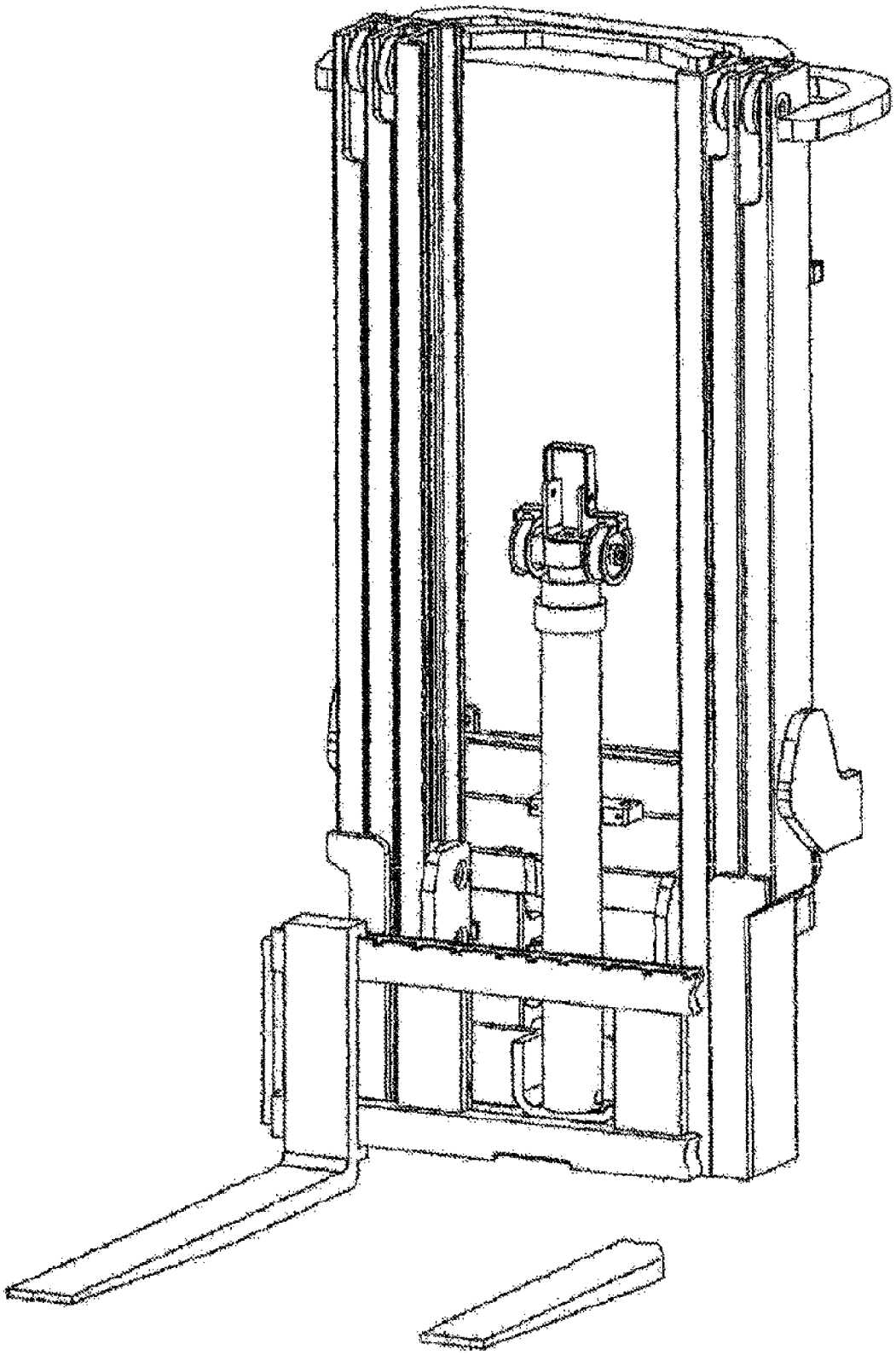
Figure-11 PRIOR ART
FIG. 11 is a perspective view of the most conventional prior art mast assembly

The inner mast (16) in the invention is formed by rigidly connecting two horizontally spaced inner mast profiles (29) with an inner mast lower cross-tie (23) between their lower ends and an inner mast upper cross-tie (17) between their upper ends. A pair of inner mast anchors (19) are fixed rearwardly of the inner mast profiles (29). A pair of multifunctional lift bases (22), which act as bases for the free-lift cylinders (21) as well as anchorages for the lift chains (3) are connected to the inner mast lower cross-tie (23) symetrically on the left and right. The multifunctional lift bases (22) position the free-lift cylinders (21) laterally symetrically behind the inner mast profiles (29), providing maximized forward visibility through the mast assembly, without free-lift cylinders (21) obstructing the space between the inner mast profiles (29). A free-lift chain pulley (20) is mounted to the top ends of each free-lift cylinder (21) rod. A pair of free-lift chains (18) extend over each free-lift chain pulley (20) with each one attached to the inner mast chain anchor (19) on one end and to the carriage anchor (25) on the other end. (FIGS. 1, 2, 10)

The carriage (30) in the invention is formed by rigidly connecting a pair of spaced apart carriage profiles (35) with two vertical support plates (26). A pair of carriage lift brackets (27) extend rearward from the vertical support plates (26). The carriage (30) slidably mounts to the inner mast (16) via attached bearings (9) on the outer surface of the carriage lift brackets (27). A carriage anchor (25) mounted on each carriage lift bracket (27) secures the free-lift chain (18) to the carriage (30). Load carrying L-shaped forks (24) are hooked on the carriage profiles (35) and extend forwardly. (FIGS. 1, 2)

The bearing (9) mounted sections of inner mast profiles (29), middle mast profiles (12) and outer mast profiles (2) have appropriately dimensioned cut-outs (28). (FIG. 1)

An important characteristic of the invention is the utilization of multifunctional lift bases (22). A pair of multifunctional lift bases (22), which are symmetrically mounted to the inner mast lower cross-tie (23) on the left and right extend outwardly of the inner mast profiles (29), functioning both as bases for the free-lift cylinders (21) and anchorages for the lift chains (3). Positioning the free-lift cylinders (21) laterally symmetrically behind the inner mast profiles (29), multifunctional lift bases (22), also indirectly position the free-lift chain pulleys (20) which are each mounted on top of the rods of the free-lift cylinders (21) and the free-lift chains (18) which extend over the free-lift chain pulleys (20). Thus multifunctional lift bases (22) allow positioning of the free-lift cylinders (21), free-lift chain pulleys (20) and free-lift chains (18) in a way so as they do not obstruct the operator's forward visibility through the mast assembly. Furthermore having connection points for the lift chains (3) outwardly of each inner mast profile (29), multifunctional lift bases (22) indirectly keep the lift chains (3) behind the outer mast profiles (2) in a way so as the lift chains (3) do not obstruct the operator's forward visibility through the mast assembly. (FIGS. 1, 10)

The invention is a triplex forklift mast assembly with full free-lift ability, comprised of a middle mast (11) moving vertically within an outer mast (1), an inner mast (16), moving vertically within the middle mast (11), and a carriage (30) moving vertically within the inner mast (16) in which the operator forward view is maximized, by not having any lifting components, like hydraulic cylinders or chains in between the inner mast profiles (29). When pressured hydraulic fluid is supplied from the control valve of the forklift, via hydraulic pipe (6) and hoses, the hydraulic distributor (7) directs hydraulic fluid to the lift cylinders (8) and the free-lift cylinders (21) simultaneously. Having larger effective pressure reception areas than lift cylinders (8), the free-lift cylinders (21) start to extend first. When the rods of the free lift cylinders (21) are extended, the free-lift pulleys (20) move upward, driving the free-lift chains (18), which exert a lifting force upon the carriage anchors (25). Hence, via the guidance of bearings (9), the carriage (30) is elevated within the inner mast (16), realizing the free-lift of the load. (FIG. 3) The lift cylinders (8) do not extend until the free-lift cylinders (21) reach their maximum stroke. Following the full extension of the free-lift cylinders (21), the lift cylinders (8) start to extend. When the rods of the lift cylinders (8) are extended, the middle mast (11) moves upward. Mounted to the middle mast (11), the lift chain pulleys (13) also move upward, driving the lift chains (3) which exert a lifting force upon the multifunctional lift bases (22). Hence via guidance of bearings (9), the middle mast (11) elevates within the outer mast (1) and the inner mast (16) elevates within the middle mast (11) simultaneously. Remaining at its relative highest position within the inner mast (16), the carriage (30) elevates together with the inner mast (16). (FIG. 5) When the lift cylinders (8) are fully extended, the carriage (30) reaches a predetermined vertical upper limit, which is the maximum lifting height of the mast assembly. (FIG. 6)

FIG. 2 is a perspective view of the invention, showing the carriage (30) at its lowest position in vertical direction.

Figure 12:
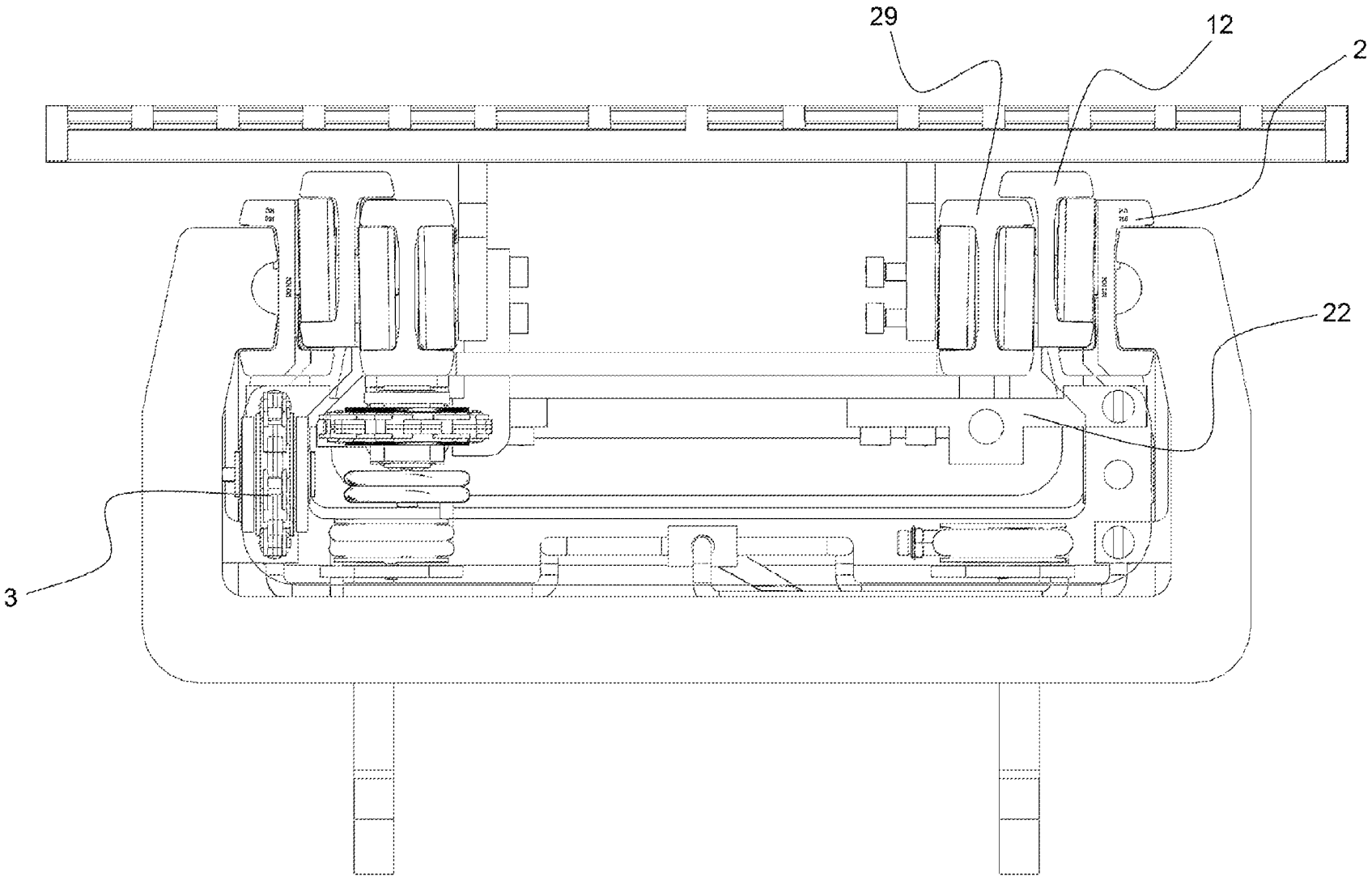
FIG. 12 is a top view of mast set showing the positions according to each other.

It may be seen in FIG. 12 that while the middle mast (11) is nested forwardly of the outer mast (1), the inner mast (16) is longitudinally aligned with the outer mast (1). Each mast profile having an I-shaped cross section, this arrangement of masts is an important characteristic of the invention, allowing the utilization of the multifunctional lift base (22). Without the middle mast profiles (12) overlapping the longitudinally aligned rear flanges of inner mast profiles (29) and outer mast profiles (2), multifunctional lift base (22) mounts to the inner mast (16) rearwardly and realize the outer mast's (1) connection with the inner mast (16) via the lift chain (3). (12)

Figure 3:
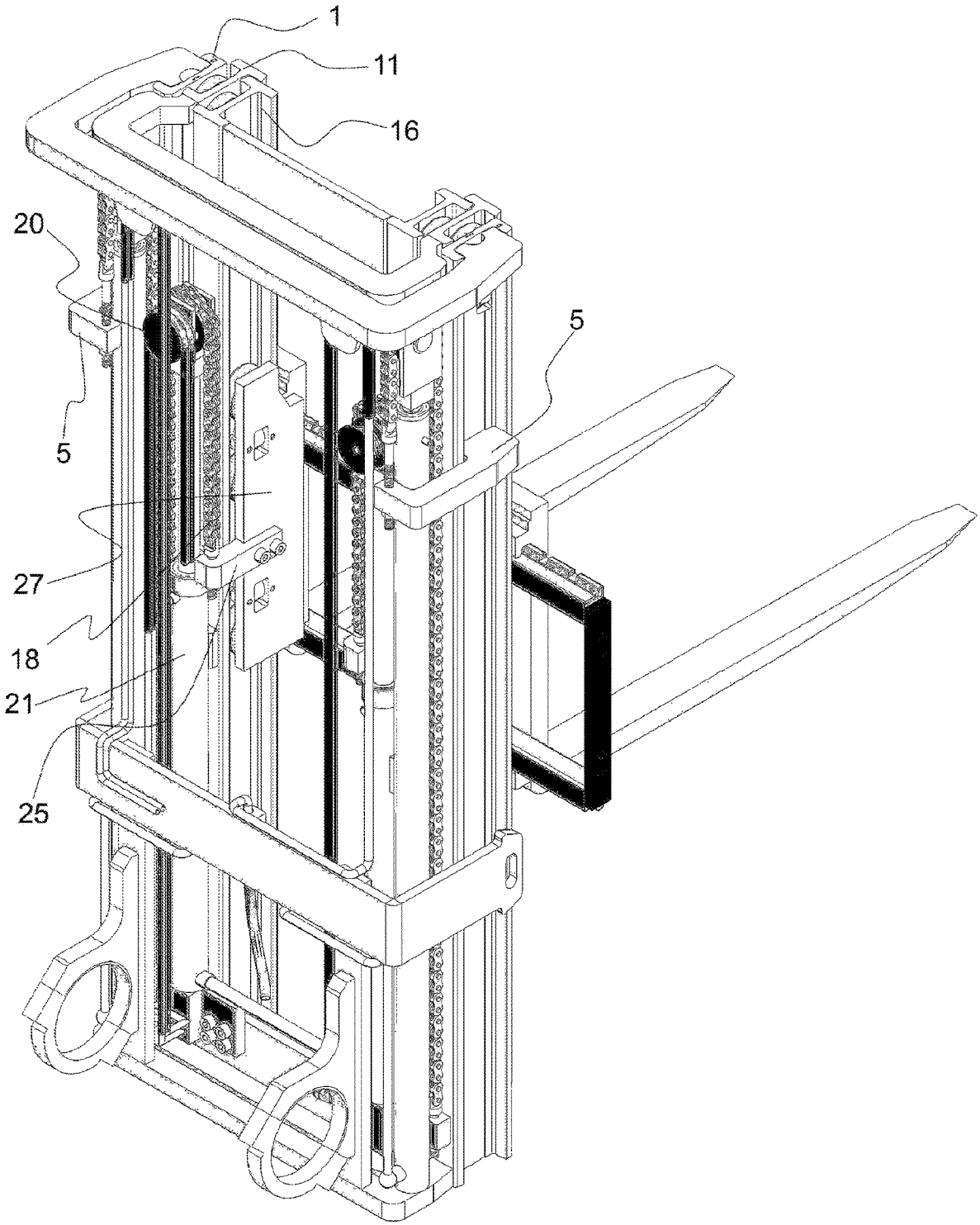
FIG. 3 is a perspective view of the mast assembly showing partial elevation of the carriage and forks during free lifting phase

FIG. 3 shows the free-lift phase of the invention in which the carriage (30) is elevated within the inner mast (16). It may be seen that the rods of the free lift cylinders (21) are extended, thus the free-lift pulleys (20) are raised. The free-lift chains (18), which are each connected to a stationary inner mast chain anchor (19), exert a lifting force upon each carriage anchor (25). Hence, via the guidance of bearings (9), the carriage (30) is elevated within the inner mast (16), realizing the free-lift of the load. The middle mast (11) and the inner mast (16) do not move during this phase.

Figure 4:
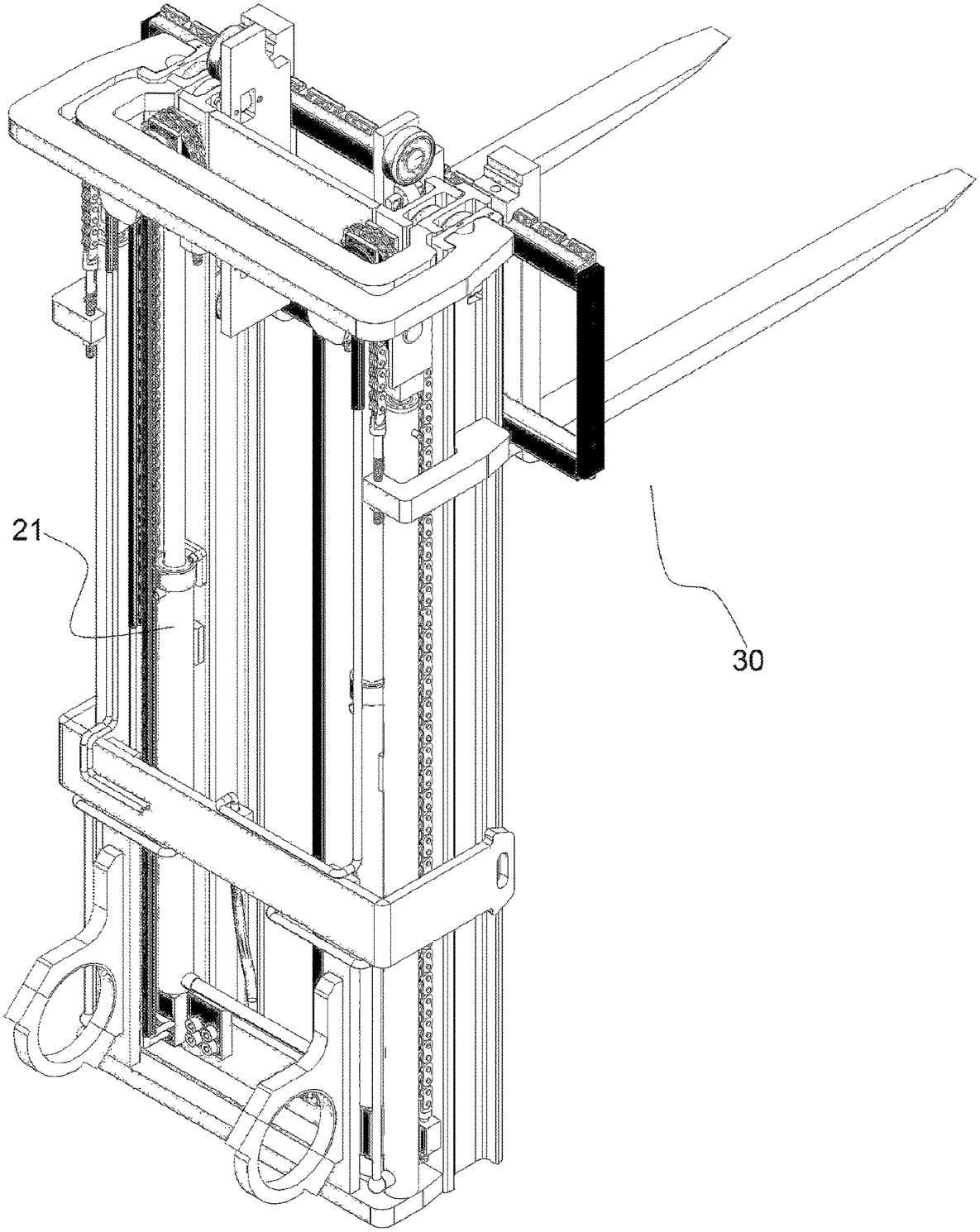
FIG. 4 is a perspective view of the mast assembly when free lifting is completed

FIG. 4 shows the full free-lift of the mast assembly, in which the carriage (30) is at maximum elevation within the inner mast (16), right before the extension of the middle mast (11) and the inner mast (16). In the invention, the completed full free-lift can be seen in FIG. 4.

Figure 5:
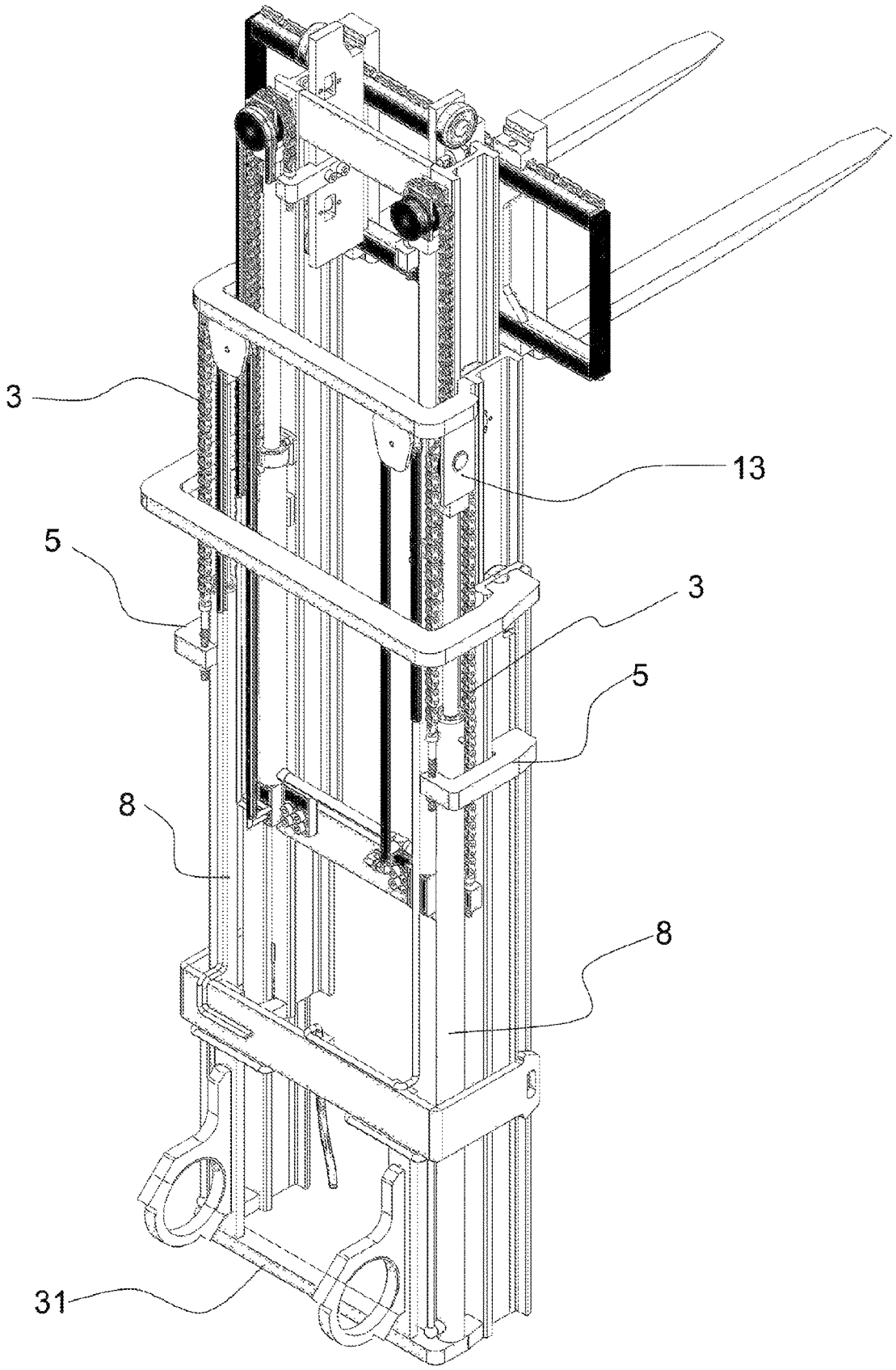
FIG. 5 is a perspective view of the mast assembly showing partial elevation of the inner mast and the middle mast during mast extension phase
Figure 6:
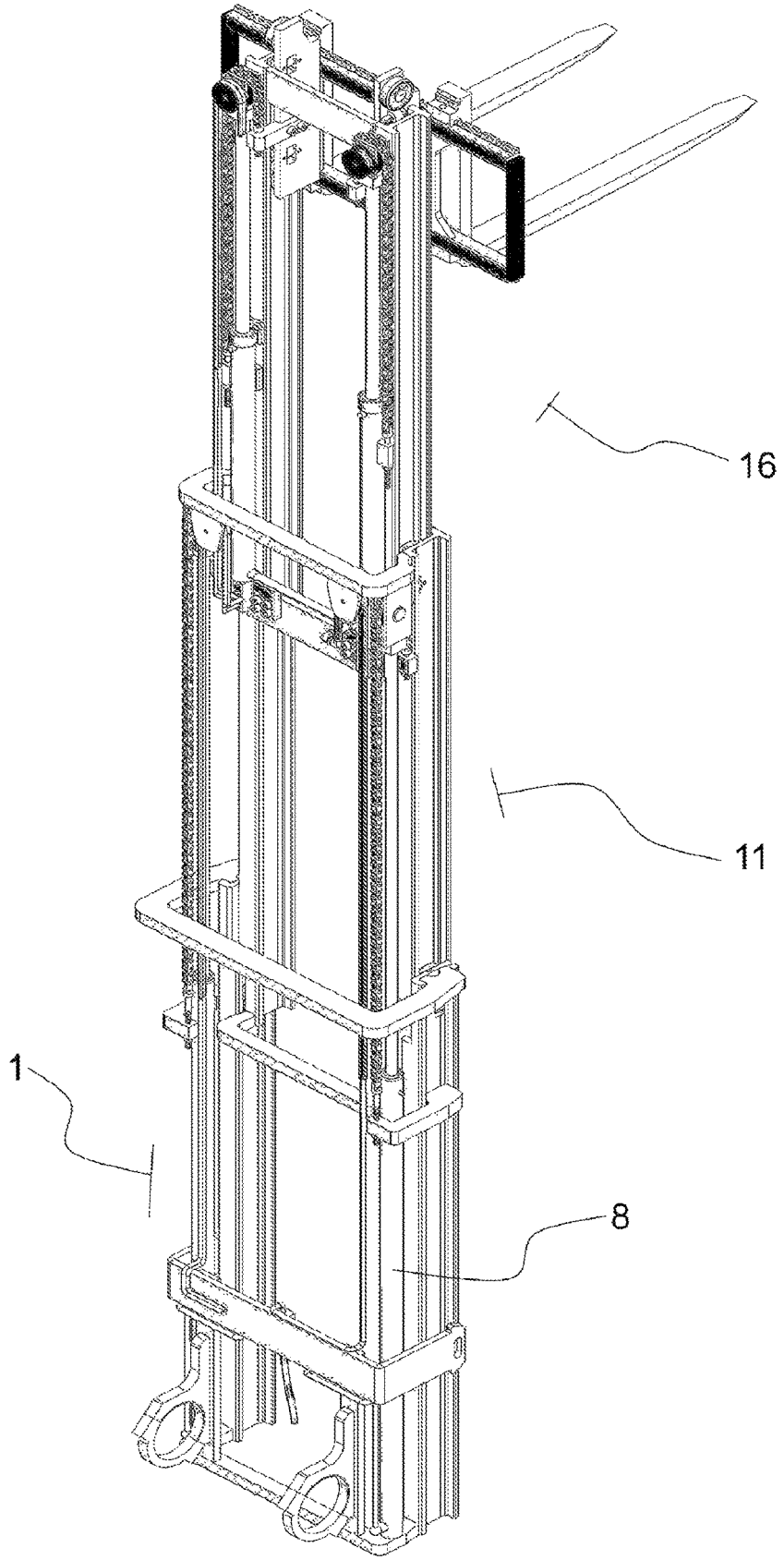
FIG. 6 is a perspective view of the mast assembly in fully extended position

FIG. 5 shows the mast extension phase of the mast assembly, in which the inner mast (16) is elevated within the middle mast (11) and the middle mast (11) is elevated within the outer mast (1) simultaneously. The carriage (30) remains at its maximum elevated position within the inner mast (16), but the vertical extension of the inner mast (16) results in further elevation of the carriage (30), thus the load, with respect to the stationary outer mast (1). It may be seen that the rods of the lift cylinders (8) are extended, thus the middle mast (11) is raised. The lift chains (3), which are each connected to a stationary outer mast chain anchor (5), exert a lifting force upon each multifunctional lift base (22). Hence, via the guidance of bearings (9), the inner mast (16) is elevated within the middle mast (11) and the middle mast (11) is elevated within the outer mast (1) simultaneously, realizing further lifting of the load.

FIG. 6 shows the mast assembly fully extended, in which the carriage (30) is at maximum elevation with respect to the stationary outer mast (1). It may be seen that the rods of the lift cylinders (8) are fully extended, thus the middle mast (11) and the inner mast (16) are each raised to their respective predetermined vertical upper limits.

Figure 7:
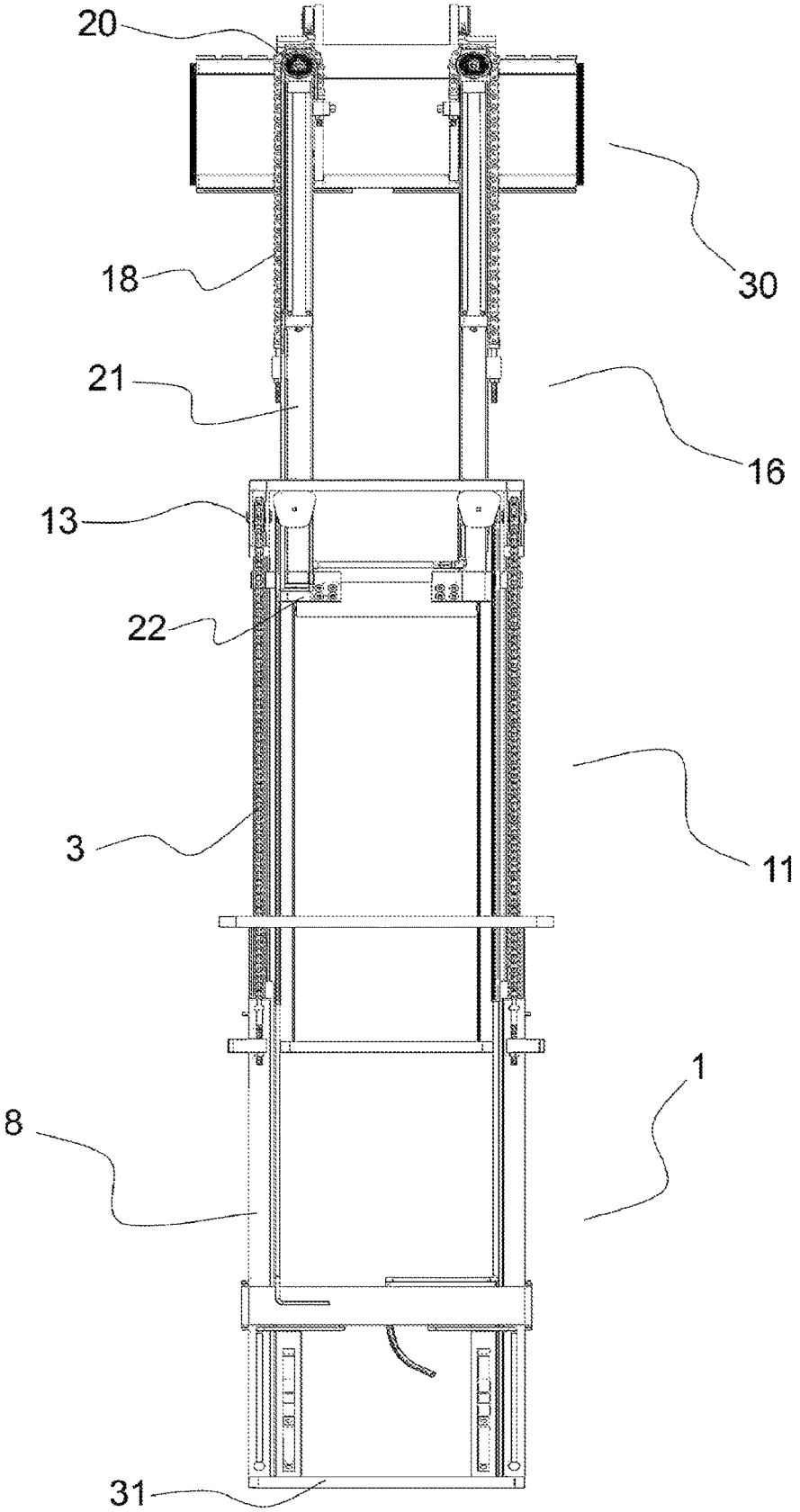
FIG. 7 is a rear view of the mast assembly in FIG. 6 showing maximized operator forward visibility and the symmetry of the invention

FIG. 7 shows the rear view of the fully extended mast assembly. When compared with a conventional mast assembly, the innovative structure of the invention can be clearly seen in FIG. 7, with none of the lifting components obstructing the space between the inner mast profiles (29). Mounted on top of the multifunctional lift bases (22), the free-lift cylinders (21) are positioned laterally symmetrically behind the inner mast profiles (29) and do not obstruct the space between the inner mast profiles (29). Mounted on top of the rods of the free-lift cylinders (21), free-lift chain pulleys (20) do not obstruct the space between the inner mast profiles (29). Extending over the free-lift chain pulleys (20), free-lift chains (18) provide maximized forward visibility through the mast assembly. Mounted on top of the lower cross-tie (31), the lift cylinders (8) are positioned laterally symmetrically behind the outer mast profiles (2) and do not obstruct the space between the inner mast profiles (29). Mounted to the middle mast upper cross-tie (32), lift chain pulleys (13) do not obstruct the space between the inner mast profiles (29). Extending over the lift chain pulleys (13), lift chains (3) do not obstruct the space between the inner mast profiles (29).

In the invention, a hydraulic hose pulley (14) is mounted to the middle mast upper cross-tie (32), thus during the mast extension phase, the hydraulic hose pulley (14) elevate together with the middle mast (11). A hydraulic hose (34) extend over the hydraulic hose pulley (14) without obstructing the space between the inner mast profiles (29). One end anchored to the hydraulic pipe (6) and the other end connected to the free-lift cylinders (21), the hydraulic hose (34) directs the hydraulic fluid supplied from the hydraulic distributor (7) and the hydraulic pipe (6) to the free-lift cylinders (21) at all vertical lift positions of the masts. The hydraulic hose (34), has constant tension along its length at all vertical lift positions of the masts.

Therefore, the invention is a triplex forklift mast assembly, having full free-lift ability, with vastly improved operator front view, comprising of an outer mast (1), a middle mast (11), an inner mast (16) and a carriage (30), which is characterized by including a pair of lift cylinders (8), that are mounted on top of a lower cross-tie (31) and one positioned laterally symmetrically behind each outer mast profile (2) without said lift cylinders (8) obstructing the space between the inner mast profiles (29); a pair of lift chains (3), driving the inner mast (16) in vertical direction, with each connected to an outer mast chain anchor (5) on one end and to a multifunctional lift base (22) on the other end, disposed over laterally symmetrically positioned lift chain pulleys (13), which are mounted to the middle mast upper cross-tie (32) rearwardly of the middle mast (11), without said lift chains (3) obstructing the space between the inner mast profiles (29); a pair of free-lift cylinders (21), located rearwardly of the inner mast (16), mounted on top of each multifunctional lift base (22), which upon commands from the operator extend or retract, thus move the free-lift chain pulleys (20) accordingly in vertical direction, without said free-lift cylinders (21) obstructing the space between the inner mast profiles (29); a pair of free-lift chains (18), driving the carriage (30) in vertical direction, with each one connected to an inner mast chain anchor (19) on one end, and to a carriage anchor (25) on the other end, disposed over laterally symmetrically positioned free-lift chain pulleys (20) which are mounted on top of the free-lift cylinders (21), with said free-lift chains (18) providing maximized forward visibility through the mast assembly; and a pair of multifunctional lift bases (22) mounted to the inner mast (16) which position the free-lift cylinders (21) symmetrically behind the inner mast profiles (29), providing maximized forward visibility through the mast assembly, without free-lift cylinders (21) obstructing the space between the inner mast profiles (29), in addition to providing symmetric connection points for the lift chains (3) rearwardly of the inner mast (16) and laterally outwardly from each of the inner mast profiles (29).

The invention claimed is:

1. A forklift mast assembly comprising:

an outer mast;

a middle mast;

an inner mast;

a carriage;

a pair of lift cylinders positioned rearwardly of said outer mast, said pair of lift cylinders being mounted on top of a lower cross-tie, said pair of lift cylinders being extendable or retractable so as to move said middle mast in a vertical direction, said pair of lift cylinders not obstructing a space between profiles of said inner mast;

a pair of lift chains cooperative with said inner mast so as to drive said inner mast in a vertical direction, each of said pair of lift chains having one end connected to a chain anchor of said outer mast, each of said pair of lift chains having another end connected to a multifunctional lift base, said pair of lift chains being disposed over laterally symmetrically positioned lift chain pulleys, the lift chain pulleys being mounted to an upper cross-tie of said middle mast rearward of said middle mast, said pair of lift chains not obstructing the space between the profiles of said inner mast;

a pair of free-lift cylinders positioned rearwardly of said inner mast, said pair of free-lift cylinders being mounted on top of each of the multifunctional lift bases, said pair of free-lift cylinders being extendable or retractable sous to move free-lift chain pulleys in a vertical direction, said pair of free-lift cylinders not obstructing the space between profiles of said inner mast; and a pair of free-lift chains drivingly connected to said carriage so as to drive said carriage in a vertical direction, each of said pair of free-lift chains having one end connected to a chain anchor of said inner mast and an opposite end connected to an anchor of said carriage, said pair of free-lift chains disposed over laterally symmetrically positioned free-lift chain pulleys, the free-lift chain pulleys being mounted on top of said pair of free-lift cylinders, said pair of free-lift chains not obstructing visibility through the forklift mast assembly; wherein the multifunctional lift bases are mounted to said inner mast so as to position said pair of free-left cylinders symmetrically behind the profiles of said inner mast such that said pair of free-lift cylinders are positioned outside of a lateral and a longitudinal profiles of a space defined between the profiles of said inner mast, the multifunctional lift bases having symmetric connection points for said pair of lift chains rearwardly of said inner mast and laterally outwardly from each of the profiles of said inner mast.

2. The forklift mast assembly of claim 1, wherein the chain anchor of said outer mast comprises a pair of outer mast chain anchors respectively fixed laterally symmetrically to each of the profiles of said outer mast so as to secure the one end of each of said pair of lift chains such that said pair of lift chains are connected to said outer mast.

3. The forklift mast assembly of claim 1, wherein the pair of free-lift chain pulleys are mounted respectively to top ends of a rod of each of said pair of free-lift cylinders such that the pair of free-lift chains are applied thereover.

4. The forklift mast assembly of claim 1, wherein said carriage anchor comprises a pair of carriage anchors respectively mounted to carriage lift brackets so as to secure the one end of each of said pair of free-lift chains such that said pair of free-lift chains are connected to said carriage.

5. The forklift mast assembly of claim 1, wherein the upper cross-tie of said middle mast does not interfere with vertical movements of said inner mast, said pair of free-lift cylinders, said pair of free-lift chains and the chain anchors of said inner mast, said upper cross-tie of said middle mast having connection points for rods of said pair of lift cylinders and the lift chain pulleys rearwardly of said middle mast and laterally outwardly of the profiles of said middle mast.

* * * * *